US008727470B2

(12) United States Patent
Yoshida et al.

(10) Patent No.: US 8,727,470 B2
(45) Date of Patent: May 20, 2014

(54) PRINTING DEVICE AND PRINTING METHOD

(75) Inventors: Seishin Yoshida, Nagano (JP); Tsuyoshi Sano, Nagano (JP); Takayoshi Kagata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 287 days.

(21) Appl. No.: 13/033,006

(22) Filed: Feb. 23, 2011

(65) Prior Publication Data

US 2011/0221805 A1 Sep. 15, 2011

(30) Foreign Application Priority Data

Mar. 10, 2010 (JP) ..... 2010-052598

(51) Int. Cl.
*B41J 29/38* (2006.01)
*B41J 2/045* (2006.01)

(52) U.S. Cl.
CPC ..... *B41J 2/04541* (2013.01); *B41J 2/0458* (2013.01)
USPC ..... 347/9; 347/5; 347/40

(58) Field of Classification Search
CPC .. B41J 2/04541; B41J 2/0458; B41J 2/04581; B41J 2/04588; B41J 2/04543
USPC ..... 347/9, 40, 101, 5; 430/5, 32
See application file for complete search history.

(56) References Cited

U.S. PATENT DOCUMENTS 6,142,620 A 11/2000 Sagi
7,244,021 B2 * 7/2007 Arai ..... 347/102
7,407,277 B2 8/2008 Yoneyama
7,798,602 B2 9/2010 Kobayashi et al.
2005/0043436 A1 * 2/2005 Kwan et al. ..... 523/160
2005/0179725 A1 * 8/2005 Matsushima ..... 347/40
2005/0237352 A1 10/2005 Yoneyama
2005/0269416 A1 * 12/2005 Sussmeier et al. ..... 235/494
2006/0268080 A1 * 11/2006 Nakazawa ..... 347/86
2007/0181037 A1 * 8/2007 Vasudevan ..... 106/493
2008/0248405 A1 * 10/2008 Almanza-Workman et al. . 430/5
2009/0322814 A1 12/2009 Sano

FOREIGN PATENT DOCUMENTS

JP 2005-254806 A 9/2005
JP 2007-050555 A 3/2007
JP 2010-005878 A 1/2010
WO 2005/105452 A1 11/2005

* cited by examiner

*Primary Examiner* — Manish S Shah
*Assistant Examiner* — Yaovi Ameh
(74) *Attorney, Agent, or Firm* — Global IP Counselors, LLP

(57) ABSTRACT

The printing device for carrying out printing on a translucent printing medium includes: a print head having a first applying portion for applying a first color material onto the printing medium, a second applying portion for applying a second color material, and a third applying portion for applying an opaque specialty ink; a conveying portion for conveying the printing medium relative to the print head; and a printing control portion configured to execute printing according to a printing mode in which a first color-producing layer of the first color material is formed on the conveying printing medium using the first applying portion, an opaque light-blocking layer of the specialty ink is formed using the third applying portion, and a second color-producing layer of the second color material is formed over the light-blocking layer using the second applying portion after the light-blocking layer is formed.

10 Claims, 13 Drawing Sheets

PRINTING DEVICE AND PRINTING METHOD

CROSS-REFERENCE TO RELATED APPLICATIONS

This application claims priority to Japanese Patent Application No. 2010-052598 filed on Mar. 10, 2010. The entire disclosure of Japanese Patent Application No. 2010-052598 is hereby incorporated herein by reference.

BACKGROUND

1. Technical Field

The present invention relates to a printing device and to a printing method.

2. Related Art

Techniques known in the past for carrying out printing using specialty inks in addition to color inks include, for example, the technique disclosed in Japanese Laid-Open Patent Application Publication No. 2007-50555.

This technique is intended to prevent color mixing between white ink and color inks, in instances where white ink is used as a specialty ink. However, the technique lacks sufficient consideration in relation to printing with specifically focus upon the type of inks used as the color inks and the qualities thereof. Nor is sufficient consideration given to printing in a manner that utilizes the features of a translucent printing medium.

SUMMARY

With the foregoing in view, it is an object of the present invention to provide a technique adapted to carry out printing in a manner that utilizes the features of a translucent printing medium.

The above objects of the invention may be attained at least in part according to the following modes or aspects of the invention.

A printing device according to a first aspect is a printing device for carrying out printing on a translucent printing medium. The printing device includes a print head, a conveying portion, and a printing control portion. The print head has a first applying portion configured to apply a first color material onto the printing medium, a second applying portion configured to apply a second color material onto the printing medium, and a third applying portion configured to apply an opaque specialty ink onto the printing medium. The conveying portion is configured to convey the printing medium relative to the print head. The printing control portion is configured to execute printing on the printing medium being conveyed according to a first printing mode in which a first color-producing layer of the first color material is formed using the first applying portion and an opaque light-blocking layer of the specialty ink is formed using the third applying portion, and a second color-producing layer of the second color material is formed over the light-blocking layer using the second applying portion after the light-blocking layer is formed.

According to the first aspect, the first and second color-producing layers are formed to either side of the light-blocking layer, and therefore by printing one of the faces of the printing medium, there can be formed a second color-producing layer that is viewable from the printed face side of the printing medium, and a first color-producing layer that is viewable from the back face side of the printed face. That is, printing can be carried out in a manner that utilizes the features of a translucent printing medium.

A printing device according to a second aspect is the printing device according to the first aspect wherein the first color material is a dye-based ink, the second color material is a pigment-based ink, and the specialty ink is a specialty gloss ink.

According to the second aspect, the dye-based ink penetrates to the lower layer side of the light-blocking layer which is formed by the specialty gloss ink (herein also termed the "special gloss layer"), where it produces color. If the printed translucent printing medium is viewed from the back face side of the printed face, the first color-producing layer of dye based color ink that has penetrated into the printing medium is seen to overlap the special gloss layer printed with specialty gloss ink. The first color-producing layer which overlaps the special gloss layer printed with specialty gloss ink produces the color of the dye based color ink with good saturation; and because dye based color inks are highly translucent, the effect of the special gloss area situated on the lower layer side does not suffer. As a result, it is possible both to preserve the gloss effect and to preserve the color saturation of color printing in an image printed concomitantly with specialty gloss ink and dye based color ink. Further, the printed result afforded by the second color-producing layer may be ascertained by viewing the printed translucent printing medium from the printed face. That is, color images having gloss effect may be obtained on both faces of the translucent printing medium.

The specialty gloss ink for creating a special gloss effect herein is an ink that creates special gloss on the surface of a printing medium that has undergone printing, such as an effect-producing ink containing a pigment that produces a prescribed effect. Metallic inks, which are one example of such specialty gloss inks, contain metal pigments that produce a metallic effect after being fixed onto the surface of a printing medium. Other examples of specialty gloss inks are pearlescent gloss inks containing pigments that produces a pearlescent gloss effect after being fixed onto the surface of a printing medium, for example, a pigment containing multiple stacked thin layers having a pearl color like natural pearl; or lamé inks or translucent inks containing pigments that have microscopic irregularities so as to give rise to scattered reflection after being fixed onto the surface of a printing medium, to create a so-called lamé or translucent effect. Metallic ink, which is one example of the specialty gloss ink herein, refers to an ink having metallic gloss, this metallic gloss being produced by a metal pigment contained in the metallic ink. As metallic inks of this kind, there may be employed oil-based ink compositions containing metal pigments, organic solvents, and resins. In order to effectively produce a metallic gloss effect, it is preferable for the aforementioned metal pigment to have the form of flake-shaped particles; in preferred practice, where the major axis on the plane of the flake-shaped particle is denoted by X, the minor axis by Y, and the thickness by Z, the 50% average particle size R50 of the equivalent circle diameter calculated from the surface area of the X-Y plane of the flake-shaped particle is 0.5 to 3 μm, and the condition R50/Z>5 is met. It is possible for such metal pigments to be formed, for example, from aluminum or aluminum alloy, or prepared by crushing of a deposited metal film. The metal pigment concentration in the metallic ink may fall between 0.1 to 10.0 wt %, for example. Of course, metallic inks are not limited to the above formulation, and it is possible for other formulations to be employed appropriately, provided that the formulation gives rise to metallic gloss.

Optionally, the specialty gloss ink is one that when printed onto the surface of a medium has optical properties that are reflection angle-dependent. One example of these specialty gloss inks, namely a metallic ink, is discussed below in terms of the metallic effect from the standpoint of optical properties. Because metallic effect is the result of perception of reflected light, the optical properties thereof are reflection angle-dependent, and various indices for representing such metallic effect have been proposed. Accordingly, metallic inks that produce a metallic effect may be defined in terms of such an index. For example, the widely known metallic effect index value In1 represented by Equation (1) below may be used. By illuminating a measurement specimen (a printed specimen having metallic effect) from a −45 degree angle and measuring the brightness of reflected light at three different locations as specified in Equation (1), this metallic effect index value In1 may be derived from the relationship of brightness observed at these three locations. Consequently, with this metallic effect index value In1, metallic inks can be may be defined in the same manner as the aforementioned metal pigments for producing metallic effect.

Equation (1)

$$In1 = \frac{2.69(L_1^* - L_3^*)^{1.11}}{L_2^{*0.86}} \quad (1)$$

$L_1$*: brightness at 30 degree light reception angle (irradiation angle −45 degrees)

$L_2$*: brightness at 0 degree light reception angle (irradiation angle −45 degrees)

$L_3$*: brightness at −65 degree light reception angle (irradiation angle −45 degrees)

Other indices of metallic effect may be employed instead, such as the metallic effect index value In2 represented by Equation (2) below, or the metallic effect index value In3 represented by Equation (3) below, using brightness at the three locations that specify the first metallic effect index value In1.

Equation (2)

$$In2 = \frac{3(L_1^* - L_3^*)}{L_2^*} \quad (2)$$

Equation (3)

$$In3 = L_1^* - L_3^* \quad (3)$$

Because all of the index values indicated by the above equations are derived as numerical values dependent on reflection angle, it is possible for specialty gloss inks to be specified in terms of these index values.

The dye based color inks herein are inks adapted to penetrate into the ink absorption layer of a printing medium and produce color in the ink absorption layer. These dye based color inks are inks that contain dyes as organic coloring matter, and that produce the color of the organic coloring matter contained therein. The dyes may be either natural dyes or synthetic dyes. Examples of colors used in color printing and examples of dye-based inks of those colors are given below.

For example, to describe an example using light cyan and light magenta in addition to the usual four colors of ink of cyan, magenta, yellow, and black, the cyan ink is one obtained by dissolving Direct Blue 99, an example of a dye that produces cyan color, in a solvent of, for example, a mixture of diethylene glycol for viscosity adjustment purposes and water. The light cyan ink is one obtained by dissolving the aforementioned dye that produces cyan color dye in the aforementioned solvent, but at a lower concentration of this dye. The magenta ink is one obtained by dissolving Acid Red 289, an example of a dye that produces magenta color, in the aforementioned solvent. The light magenta ink is one obtained by dissolving the aforementioned dye that produces magenta color dye in the aforementioned solvent, but at a lower concentration of this dye. The yellow ink is one obtained by dissolving Direct Yellow 86, an example of a dye that produces yellow color, in the aforementioned solvent. The black ink is one obtained by dissolving Hood Black 2, an example of a dye that produces black color, in the aforementioned solvent. These dye based color inks may undergo viscosity adjustments after having respectively adjusted the dye concentration, and the concentrations of the diethylene glycol for viscosity adjustment purposes and of the water.

A printing device according to a third aspect is the printing device according to the first or second aspect wherein the printing control portion is further configured to execute printing on the printing medium being conveyed according to a second printing mode which is a printing mode different from the first printing mode, so that the first color-producing layer of the first color material is formed on the printing medium using the first applying portion, and the opaque light-blocking layer of the specialty ink is formed on the printing medium using the third applying portion in the second printing mode.

According to the third aspect, an effect comparable to the aforementioned second aspect may be achieved in relation to viewing a printed translucent printing medium from the back face side of the printed face.

A printing device according to a fourth aspect is the printing device according to the third aspect wherein the printing control portion is further configured to execute printing on the printing medium being conveyed according to a third printing mode which is a printing mode different from the first and second printing modes, so that the opaque light-blocking layer of the specialty ink is formed on the printing medium using the third applying portion, the second color-producing layer of the second color material is formed over the light-blocking layer using the second applying portion after the light-blocking layer is formed.

According to the fourth aspect, an effect comparable to the aforementioned second aspect may be achieved in relation to viewing a printed translucent printing medium from the printed face side.

A printing device according to a fifth aspect is the printing device according to the fourth aspect, further including a selection portion providing an interface allowing selection of one of the first, second and third printing modes when printing is executed. The printing control portion is preferably configured to execute printing according to the one of the first, second and third printing modes selected by the selection portion.

According to the fifth aspect, a printing mode that reflects the selection of the user can be executed.

A printing device according to a sixth aspect is the printing device according to any of the first to fifth aspects wherein the print head is a serial head that travels relative to a width direction of the printing medium, the first, second and third applying portions include nozzles configured to respectively eject the first and second color materials and the specialty ink, the nozzles being arrayed in a direction that intersects a direction of travel of the serial head, and the conveying portion is configured to convey the printing medium relative to the direction that intersects the direction of travel of the serial head.

According to the sixth aspect, formation of the first and second color-producing layers and the light-blocking layer can be accomplished in a printing device furnished with a serial head.

A printing device according to a seventh aspect is the printing device according to the sixth aspect wherein the printing control portion is configured to carry out formation of the light-blocking layer concurrently with formation of the first color-producing layer in a single pass of travel by the serial head, and the printing control portion is configured to carry out formation of the second color-producing layer during travel which chronologically follows traveling of the serial head during which the light-blocking layer was formed.

According to the seventh aspect, formation of the light-blocking layer and formation of the first color-producing layer are carried out concomitantly during a single pass of travel by the serial head, whereby the time required for printing can be shorter.

A printing device according to an eighth aspect is the printing device according to any of the first to fifth aspects wherein the first, second and third applying portions include nozzles configured to respectively eject the first and second color materials and the specialty ink, the print head is a line head in which the nozzles are arrayed in a width direction of the printing medium, and the nozzles belonging to the second applying portion are disposed on a downstream side of the first and third applying portions, in a direction in which the printing medium is conveyed by the conveying portion with respect to the line head.

According to the eighth aspect, formation of the first and second color-producing layers and the light-blocking layer can be accomplished in a printing device furnished with a line head.

A printing method according to a ninth aspect is a printing method for printing onto a translucent printing medium. The printing method includes: forming a first color-producing layer on the printing medium using a first color material, and forming an opaque light-blocking layer on the printing medium using a specialty ink; and forming a second color-producing layer over the light-blocking layer using a second color material.

According to the ninth aspect, the first and second color-producing layers are formed to either side of the light-blocking layer, and therefore by printing one of the faces of the printing medium, there can be formed a second color-producing layer that is viewable from the printed face side of the printing medium, and a first color-producing layer that is viewable from the back face side of the printed face.

A printing device according to a tenth aspect is a printing device for carrying out printing of a printing medium. The printing device includes a print head having a first applying portion configured to apply a dye-based ink, a second applying portion configured to apply a pigment-based ink and a third applying portion configured to apply a specialty gloss ink, onto the printing medium.

According to the tenth aspect, printing can be carried out utilizing the qualities of a dye-based ink, a pigment-based ink, and a specialty gloss ink (for example, through three-layer printing using these three types of ink).

The present invention may be reduced to practice in various modes. Examples of such modes include a printing method and a printing system; an integrated circuit or computer program for accomplishing the functions of the method or system; a recording medium having the computer program recorded thereon, or the like.

BRIEF DESCRIPTION OF THE DRAWINGS

Referring now to the attached drawings which form a part of this original disclosure.

DETAILED DESCRIPTION OF EXEMPLARY EMBODIMENTS

The modes of working the invention are described below on the basis of preferred embodiments in the following order: A. Embodiments; A1. Overview of the Embodiment; A2. Device Configuration; A3. First Printing Mode; A4. Second Printing Mode; A5. Third Printing Mode; B. Other Embodiments; and C. Modified Examples.

A. Embodiments

A1. Overview of the Embodiment

Figure 1:
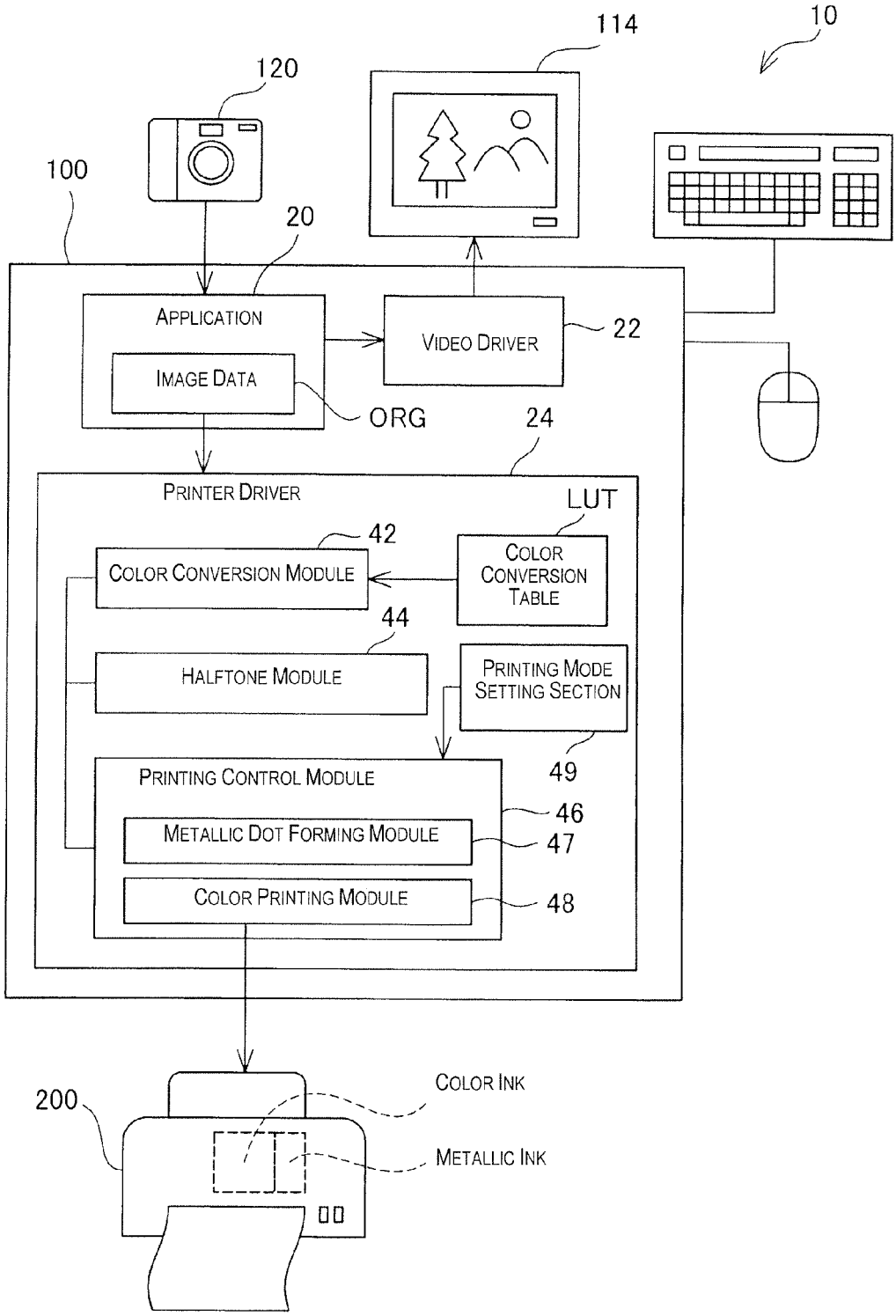
FIG. 1 is a simplified configuration diagram of a printing system 10 according to an embodiment of the invention.

FIG. 1 is a simplified configuration diagram of a printing system 10 according to an embodiment of the invention. As shown in the drawing, the printing system 10 of the present embodiment includes a computer 100 provided as a printing control device, and a printer 200 for actually printing the images under the control of the computer 100. The printing system 10 taken as a whole functions as a printing device in the broad sense.

The printer 200 of the present embodiment is provided with the dye based color inks of cyan ink (DC), magenta ink (DM), yellow ink (DY), and black ink (DK); and is additionally provided with metallic ink (S) having metallic gloss owing to a metal pigment contained therein. The printer 200 of the present embodiment is further provided with the pigment based color inks of cyan ink (PC), magenta ink (PM), yellow ink (PY), and black ink (PK). In the present embodiment, the term "color ink" is used to include black ink as well.

In the present embodiment, an oil-based ink composition containing a metal pigment, an organic solvent, and a resin is used as the metallic ink. With regard to the metal pigment contained therein, pigments having the following specifications may be contained. For example, there is employed a metal pigment of flake-shaped particle form that, where the major axis on the plane of the flake-shaped particle is denoted by X, the minor axis by Y, and the thickness by Z, has a 0.5-3 μM 50% average particle size R50 of equivalent circle diameter calculated from the surface area of the X-Y plane of the flake-shaped particle, and meets the condition R50/Z>5. In this case, it is possible to use metal pigments formed from aluminum or aluminum alloy, or metal pigments prepared by crushing of a deposited metal film. In the present embodiment, a metal pigment formed from aluminum is used. The metal pigment concentration of the metallic ink may fall between 0.1-10.0 wt %, for example; in the present embodiment, one having a concentration of 1.5 wt % is used.

The dye based color inks are color inks containing dyes of organic coloring matter for producing the colors listed above. In the present embodiment, dye based color inks of the four colors cyan, magenta, yellow, and black are used. The cyan ink contains 3.6 weight percent of Direct Blue 99 which is a dye of cyan color, this dye being dissolved in a solvent mixture of 30 weight percent of diethylene glycol for viscosity adjustment purposes, 1 weight percent of SURFYNOL 465, and 65.4 weight percent of water. The magenta ink contains 2.8 weight percent of Acid Red 289 which is a dye of magenta color, this dye being dissolved in a solvent mixture of 20 weight percent of diethylene glycol for viscosity adjustment purposes, 1 weight percent of SURFYNOL 465, and 76.2 weight percent of water.

The yellow ink contains 1.8 weight percent of Direct Yellow 86 which is a dye of yellow color, this dye being dissolved in a solvent mixture of 30 weight percent of diethylene glycol for viscosity adjustment purposes, 1 weight percent of SURFYNOL 465, and 67.2 weight percent of water. The black ink contains 4.8 weight percent of Hood Black 2 which is a dye of black color, this dye being dissolved in a solvent mixture of 35 weight percent of diethylene glycol for viscosity adjustment purposes, 1 weight percent of SURFYNOL 465, and 69.2 weight percent of water. Each ink is adjusted to viscosity of about 3 (mPa·s), for example, to avoid any difficulty in ejection from the ejection head.

Where so-called light color dye-based inks are to be used in addition to the dye based color inks listed above, the light cyan ink may be one containing Direct Blue 99, a dye of cyan color, in a reduced amount of 0.9 weight percent equivalent to one-fourth the amount in the cyan ink, this dye being dissolved in a solvent mixture of 35 weight percent of diethylene glycol for viscosity adjustment purposes, 1 weight percent of SURFYNOL 465, and 63.1 weight percent of water. The light magenta ink may be one containing Acid Red, a dye of magenta color, in a reduced amount of 0.7 weight percent equivalent to one-fourth the amount in the magenta ink, this dye being dissolved in a solvent mixture of 25 weight percent of diethylene glycol for viscosity adjustment purposes, 1 weight percent of SURFYNOL 465, and 73.3 weight percent of water. As with the dye based color inks, so-called light color inks may be used as pigment based color inks as well.

The computer 100 has a prescribed operating system installed thereon, and an application program 20 runs on this operating system. The operating system incorporates a video driver 22 and a printer driver 24. The application program 20 is designed, for example, to input image data ORG from a digital camera 120 through a peripheral interface 108. Via the video driver 22, the application program 20 displays on a display 114 an image represented by this image data ORG. Via the printer driver 24, the application program 20 outputs the image data ORG to the printer 200. The image data ORG input to the application program 20 from the digital camera 120 is data composed of the three color components red (R), green (G), and blue (B).

The application program 20 of the present embodiment is able to designate any area in the image data ORG as an area composed of the R, G, B color components (herein termed a "color producing area") or as an area printed with metallic ink herein termed a "metallic area"). There is some overlap of metallic areas and color producing areas, and in the overlapping areas, the metallic gloss of the metal pigment in the metallic ink constitutes the background color, with a color image formed thereon. That is, these overlapping areas constitute metallic/color areas. Alternatively, these may be constituted as metallic areas using metallic ink alone (exclusively metallic areas). When designating a metallic area in this way, the area in question may be designated in advance; or, for example, the application program 20 may be programmed to designate a printing area that contains graphics of specific contours as being a metallic area, or the application program 20 may be programmed to designate a printing area of specific color as being a metallic area.

In the printer driver 24 there is provided a color conversion module 42, a halftoning module 44, and a printing control module 46. Of these, the printing control module 46 includes a metallic dot forming module 47 and a color printing module 48.

Making reference to a color conversion table LUT prepared in advance, the color conversion module 42 converts the R, G, and B color components of the color producing areas in the image data ORG to color components producible with dye based color inks by the printer 200 (the colors cyan (DC), magenta (DM), yellow (DY), and black (DK)). If printing is to be carried out using the pigment based color inks, making reference to a pigment color ink color conversion table LUT prepared in advance, the color conversion module 42 converts the R, G, and B color components of the color producing areas in the image data ORG to color components producible with pigment based color inks by the printer 200 (the colors cyan (PC), magenta (PM), yellow (PY), and black (PK)). Data relating to the amount of ink in metallic areas is provided by the application program 20.

The halftoning module 44 performs a halftoning process whereby tones of the image data having undergone color conversion by the color conversion module 42 are represented by distributions of dots. In the present embodiment, the widely known systematic dither method is employed as this halftoning process. Other halftoning techniques besides the dither method, such as the error diffusion method or density pattern method, may be employed as the halftoning process.

The printing control module 46 resequences the halftone-processed image data into the proper order for transfer to the printer 200, and outputs the data as print data to the printer 200. The printing control module 46 also performs control of the printer 200 by outputting various commands, such as a Start Print command or Stop Print command, to the printer 200.

The metallic dot forming module 47 forms metallic dots of prescribed size in metallic areas specified by the application program 20. According to the present embodiment, in a metallic area the metallic pigment distribution per unit surface area can be stipulated by varying the dot size of the metallic dots, for example. For example, the metallic pigment distribution may be increased to enhance the metallic effect, or the metallic pigment distribution may be decreased to diminish the metallic effect. In this case, according to the present embodiment, in order to achieve penetration of the printed (ejected) dye based color ink to the lower side of the metallic area of metallic ink, the dot size of the metallic dots, and more specifically the metallic pigment distribution, is restricted such that the metallic pigment does not cover the entire metallic area. The color printing module 48 carries out dot formation with color ink of each of the colors on the halftone-processed image, i.e., on the image of the color producing areas.

Prior to initiation of the printing process, the printing mode setting section 49 receives an instruction from the user indicating which of the first to third printing modes to execute as the printing mode, and sets the printing mode on the basis of the received instruction. Here, the first printing mode is a mode for carrying out three-layer printing of a translucent printing medium using three types of ink, i.e., metallic ink, dye based color ink, and pigment based color ink. The second printing mode is a mode for carrying out printing of a translucent printing medium using metallic ink and dye based color ink. The third printing mode is a mode for carrying out printing of a translucent printing medium using metallic ink and pigment based color ink. These modes are described in detail later.

A2. Device Configuration

Figure 2:
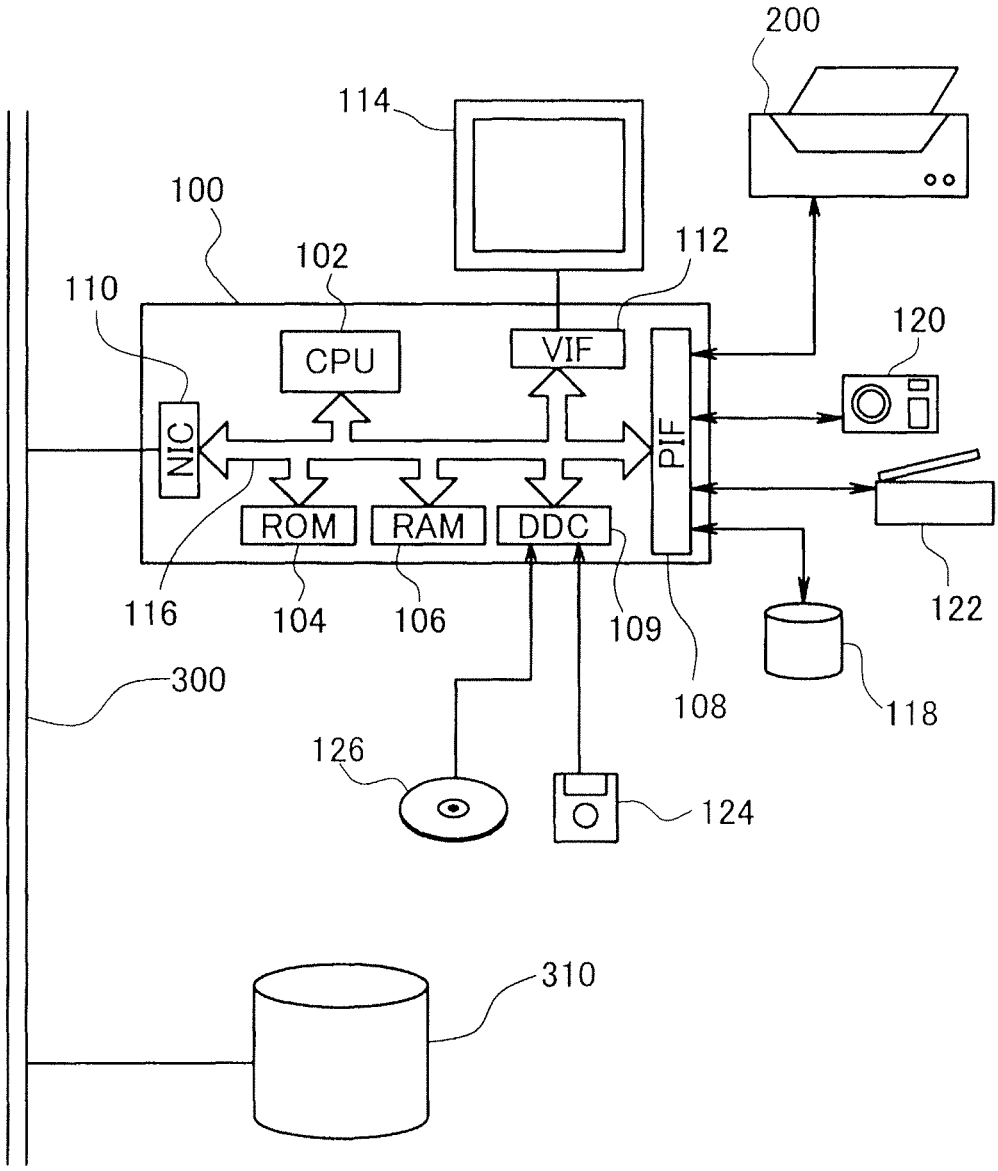
FIG. 2 is a configuration diagram of a computer 100 provided as a printing control device.

FIG. 2 is a configuration diagram of a computer 100 provided as a printing control device. The computer 100 is a computer of known design, which is centered around a CPU 102 and includes a ROM 104, a RAM 106, and so on, these components being interconnected by a bus 116.

To the computer 100 there are connected a disk controller 109 for reading data from a flexible disk 124, a compact disc 126, or the like; a peripheral interface 108 for data transfers to and from peripheral devices; and a video interface 112 for driving a display 114. The printer 200 and a hard disk 118 are connected to the peripheral interface 108. Where a digital camera 120 or a color scanner 122 is connected to the peripheral interface 108, it is possible to perform image processing of an image retrieved from the digital camera 120 or the color scanner 122. Where a network interface card 110 is installed, the computer 100 is able to connect to a communications circuit 300 and retrieve data stored in a storage device 310 that is also connected to the communications circuit. Once the computer 100 has retrieved the data to be printed, the printer 200 is controlled through operation of the printer driver 24 described above to carry out printing of this print data.

Figure 3:
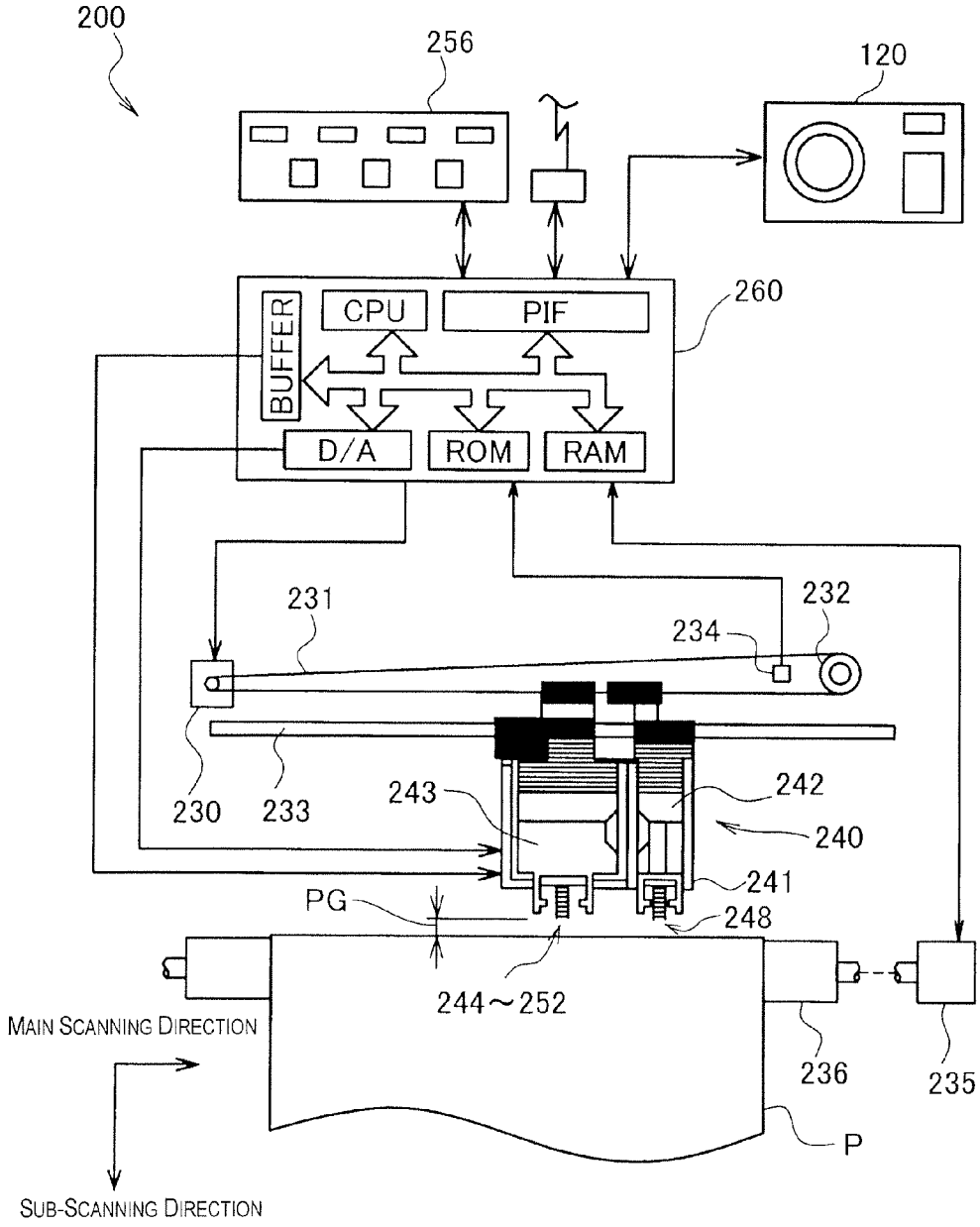
FIG. 3 is a block diagram depicting a simplified configuration of a printer 200.

The description turns next to the configuration of the printer 200. FIG. 3 is a block diagram depicting a simplified configuration of the printer 200. As shown in FIG. 3, the printer 200 includes a mechanism for conveying a printing medium P by a feed motor 235, a mechanism for causing reciprocation of a carriage 240 in the axial direction of a platen 236 by a carriage motor 230, a mechanism for driving a print head 241 installed on the carriage 240 to eject ink and form dots, and a control circuit 260 for exchange of signals with the feed motor 235, the carriage motor 230, the print head 241, and a control panel 256.

The mechanism for causing the carriage 240 to reciprocate in the axial direction of the platen 236 includes a slide rail 233 suspended parallel to the axis of the platen and adapted to slidably retain the carriage 240, a pulley 232 linked with the carriage motor 230 via an endless drive belt 231, and a position detection sensor 234 for detecting the home position of the carriage 240.

On the carriage 240 there is installed a color ink cartridge 243 containing the respective dye based color inks, i.e., the cyan ink (DC), magenta ink (DM), yellow ink (DY), and black ink (DK), and the respective pigment based color inks, i.e., the cyan ink (PC), magenta ink (PM), yellow ink (PY), and black ink (PK). A metallic ink cartridge 242 containing metallic ink (S) is installed on the carriage 240 as well. On the print head 241 at the bottom of the carriage 240 there are formed a total of ten ink ejection heads 244 to 252 corresponding to the colors of these dye based and pigment based color inks. When these ink cartridges 242, 243 are installed from above onto the carriage 240, it is possible for ink to be supplied from the cartridges to the ink ejection heads 244 to 252.

Figure 4:
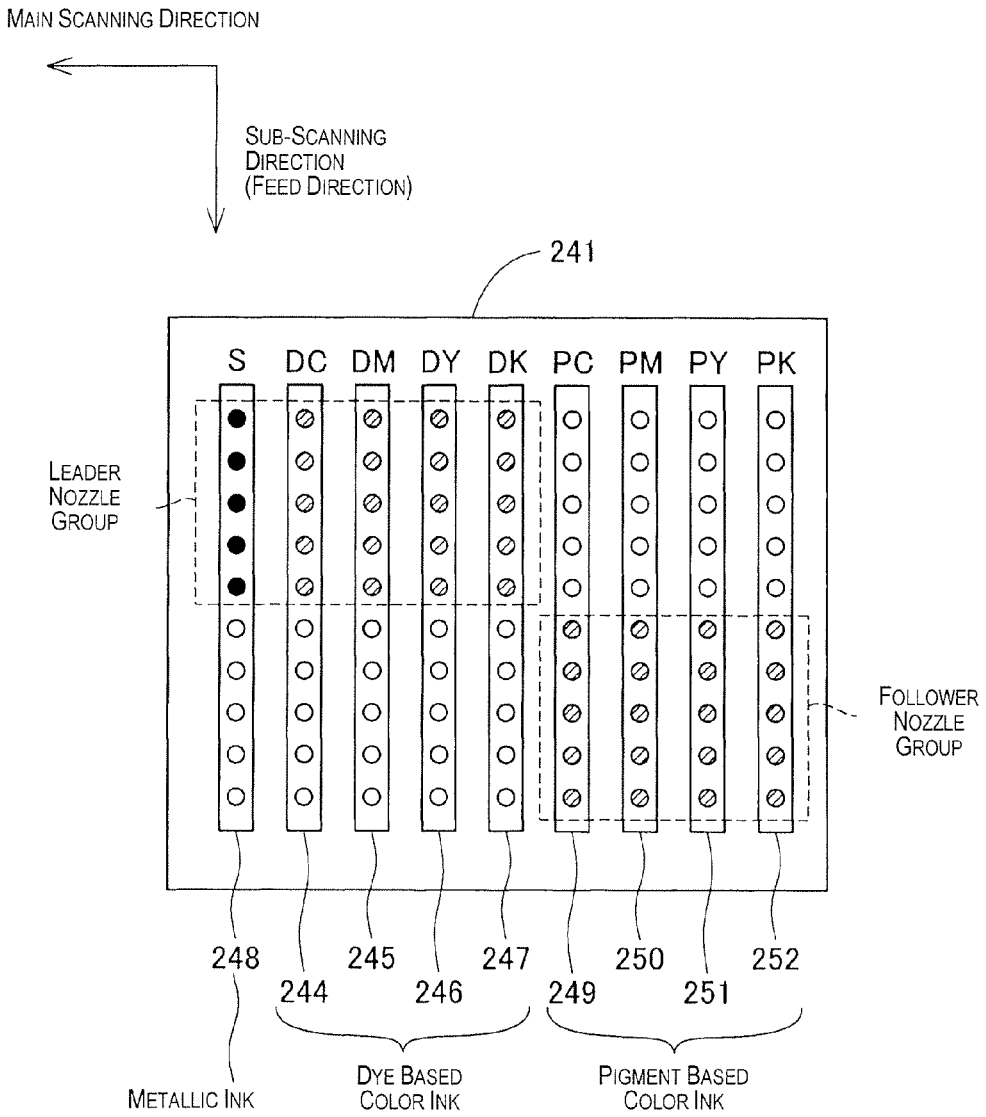
FIG. 4 is an illustration of a simplified depiction of nozzle positioning in ink ejection heads that make up a print head 241.

The print head 241 is now described. FIG. 4 is an illustration of a simplified depiction of nozzle positioning on the ink ejection heads that are part of the print head 241. As shown in the drawing, in the present embodiment, for each of the colors metallic ink (S), dye based cyan ink (DC), dye based magenta ink (DM), dye based yellow ink (DY), dye based black ink (DK), pigment based cyan ink (PC), pigment based magenta ink (PM), pigment based yellow ink (PY), and pigment based black ink (PK), there are respectively provided ten nozzles arrayed in the sub-scanning direction on the bottom face of the print head 241. Specifically, it is possible for the print head 241 of the present embodiment to eject metallic ink, dye based color inks, and pigment based color inks onto a printing medium P. The nozzles are positioned at 2-dot intervals in the sub-scanning direction. In the drawing, because the downward direction indicates the sub-scanning direction, during printing, the printing medium P passes by the nozzles starting from those shown uppermost in the drawing. In the drawing, nozzles shown in black represent nozzles for ejecting metallic ink, and nozzles shown with hatching represent nozzles for ejecting color ink. The other nozzles represent nozzles that are not used.

When executing three-layer printing in the first printing mode, as shown in FIG. 4, of the ten nozzles of the ink ejection head 248 for metallic ink, the five nozzles that the printing medium P passes by first are used during actual printing, whereas the remaining five are not used. Of the ten nozzles of each of the ink ejection heads 244-247 constituting the nozzle rows of the dye based color inks (DC, DM, DY, DK), the five nozzles that the printing medium P passes by first are not used, and the remaining five are used. Of the ten nozzles of each of the ink ejection heads 249-252 constituting the nozzle rows of the pigment based color inks (PC, PM, PY, PK), the five nozzles that the printing medium P passes by subsequent to a sub-scan are used, and the remaining five are used. Herein, where necessary to do so, the five nozzles that the printing medium P passes by first are referred to as the "leader nozzle group", and the nozzles that the printing medium P passes by subsequent to a sub-scan (i.e., chronologically subsequent to the leader nozzle group) are referred to as the "follower nozzle group".

Each of the nozzles shown in FIG. 4 incorporates a piezo element. As is widely known, piezo elements are elements that experience deformation of their crystal structure through application of an electrical voltage, and that are able to perform electrical-mechanical energy conversions in an extremely rapid manner. In the present embodiment, a prescribed voltage signal (drive signal) is applied to the piezo elements, thereby causing one side wall of the ink passage of the nozzle to deform and eject an ink droplet from the nozzle.

While according to the present embodiment, ink is ejected using piezo elements in the above manner, optionally, there could instead be employed a system of ejecting ink by generating bubbles inside the nozzles.

The control circuit 260 of the printer 200 shown in FIG. 3 includes a CPU and a ROM, a RAM, and a PIF (peripheral interface), these components being interconnected by a bus; and controls the main scanning operation and sub-scanning operation of the carriage 240 through control of operation of the carriage motor 230 and the feed motor 235. When print data output from the computer 100 is received via the PIF, it is possible to drive the ink ejection heads 244 to 252 by presenting the heads with a drive signal appropriate to the print data, in tandem with main scanning or sub-scanning of the carriage 240.

In the printer 200 having the hardware configuration described above, the ink ejection heads 244 to 252 of each color undergo reciprocating motion in the main scanning direction relative to the printing medium P through driving of the carriage motor 230 as the printing medium P travels in the sub-scanning direction through driving of the feed motor 235. Through driving of the nozzles at appropriate timing based on the print data in tandem with reciprocating motion of the carriage 240 (main scanning) and feed of the printing medium (sub-scanning), the control circuit 260 forms ink dots of the appropriate color at the appropriate locations on the printing medium P. Through this arrangement, it is possible for the printer 200 to carry out color image printing on the printing medium P, as well as to form color printing image areas that overlap metallic areas (metallic/color producing areas).

Although the printer 200 of the present embodiment is described as being an inkjet printer that ejects ink droplets towards the printing medium P in order to form ink dots thereon, the printer may be one that forms dots by any method. For example, the present invention may be favorably adapted to a printer that forms dots by depositing toner particles of each color onto a printing medium electrostatically, or to a line printer as discussed later, rather than by ejecting ink droplets.

A3. First Printing Mode

Figure 5:
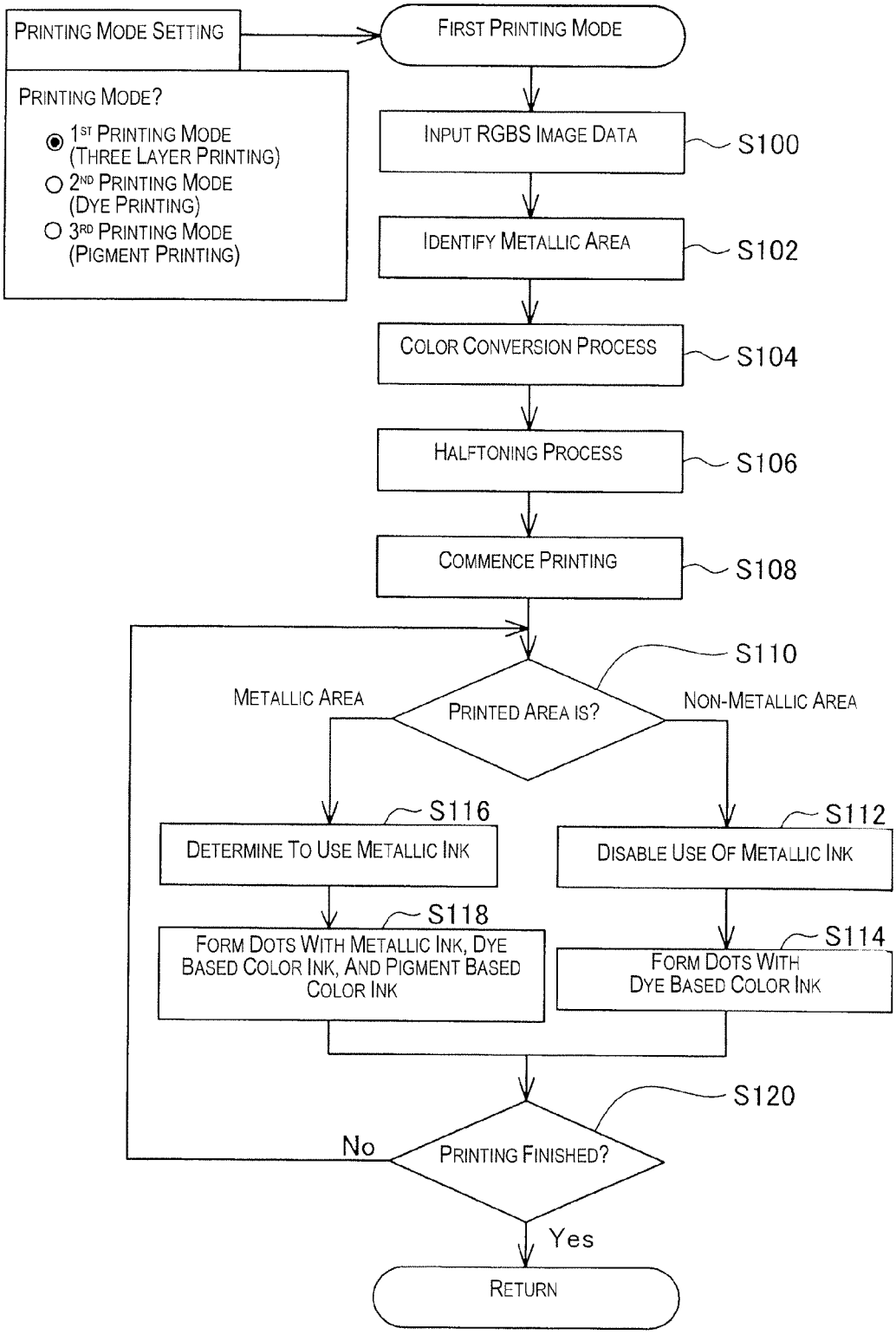
FIG. 5 is a flowchart of a printing process.

FIG. 5 is a flowchart of the printing process. According to this embodiment, the computer 100 carries out a process to identify metallic areas where metallic ink is used; and for areas other than the metallic areas, restricts the use of metallic ink so that printing is carried out using dye based color inks only. Prior to commencing the printing process, the printing mode setting section 49 displays on the display 114 an instruction reception screen for receiving from the user an instruction to execute any printing mode from among the first to third printing modes, and then sets the printing mode based on the instruction received from the user. The following description relates to the process in an instance where the first printing mode (three-layer printing mode) has been set.

When the printing process commences, the computer 100 first inputs the image data which is in RGBS format and which includes information for identifying metallic areas that has been appended by the application program (Step S100). Once the image data is input, the computer 100 identifies the metallic areas that were designated by the application program 20 (Step S102). Areas to be printed with prescribed color, inclusive of the shape thereof, also may be identified as metallic areas by the application program 20. For example, if an image includes a star (☆), the star in the image may be differentiated through image analysis of shape, color, etc., and the differentiated area then identified as a metallic area.

For non-metallic areas that are not metallic areas, the computer 100 then uses the color conversion module 42 to convert the RGBS format image data that was input in Step S100 to image data of the CMYK format for the dye based color inks (Step S104). For metallic areas, on the other hand, the computer 100 uses the color conversion module 42 to convert the RGBS format image data to image data of CMYK format for dye based color inks, as well as to convert the data to image data of CMYK format for pigment based color inks; and, from the RGBS format image data, additionally acquires data relating to the metallic ink usage amount. Once CMYK format image data for the dye based and pigment based color inks and the data relating to the metallic ink usage amount has been obtained, the computer 100 carries out a halftoning process for each ink using the halftoning module 44, and generates data that is transferable to the printer 200 (Step S106).

Once the halftoning process has finished for the entire image to be printed, the computer 100 uses the printing control module 46 to control the printer 200, and commences printing (Step S108).

Once printing has commenced, the computer 100 compares the metallic area that was identified in Step S102 with the location of current dots that were assigned through dot formation for producing the printed image, in order to decide whether the dots currently targeted for printing lie in a metallic area or a non-metallic area (i.e., a color-only area of dye based color ink alone) (Step S110). If, as a result of this decision, it is decided that the dots currently targeted for printing lie in a non-metallic area, the computer 100 disables the use of metallic ink for the dots currently targeted for printing (Step S112), and executes printing through formation of dots of dye based color ink alone (Step S114).

On the other hand, if it is decided that the dots currently targeted for printing lie in a metallic area, the computer 100 determines to use metallic ink for the dots currently targeted for printing (Step S116), and forms the dots using metallic ink as well as dye based and pigment based color inks (Step S118). Specifically, in the case of the first printing mode, during one pass of travel of the print head 241 along the main scanning direction, for the current dots targeted for printing, the metallic ink leader nozzle group is used to form dots of metallic ink and carry out printing of the metallic area while the dye based color ink leader nozzle group is used to form dots of dye based color ink, to simultaneously carry out printing of the dye based color producing area as well. Then, after the printing medium has traveled in the sub-scanning direction, the pigment based color ink follower nozzle group is used for forming dots of pigment based color ink from above the dye based color producing area and the metallic area to carry out printing of a pigment based color producing area. By this process, there is formed a three-layer metallic/color area in which the dye based color producing area, the metallic area, and the pigment based color producing area overlap. The mechanism for forming this three-layer metallic/color area is discussed in detail later.

Once formation of the dots currently targeted for printing and ink ejection have been completed in the aforementioned Step S114 or Step S118, the computer 100 decides whether printing of all of the image data has finished (Step S120). If printing of all of the image data has not yet finished, the computer 100 returns the process to Step S110, and then resumes formation of other dots. If on the other hand printing of all of the image data has finished, the printing process terminates.

Figure 6A:
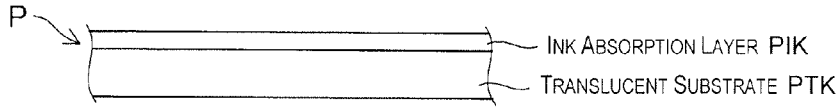
FIGS. 6A to 6D are illustrations schematically showing conditions of a printing process according to a first printing mode.

FIGS. 6A to 6D are illustrations schematically showing conditions of the printing process according to the first printing mode. The description turns first to the printing medium P. As shown in FIG. 6A, the printing medium P targeted for printing in the present embodiment includes a translucent substrate PTK of translucent polyethylene terephthalate (PET) or the like, and an ink absorption layer PIK pre-formed on the substrate surface. Because this ink absorption layer PIK is also translucent, the printing medium P is a medium having transparency as a whole. In this case, the printing medium P, oriented with the ink absorption layer PIK side as the printing face, is conveyed to the platen 236 and travels in the sub-scanning direction.

The ink absorption layer PIK pre-formed on the translucent substrate PTK has the action of fixing the dye of the dye based color ink of the aforementioned colors when penetrated by the ink, and of producing the color of the particular dye. For example, for the ink absorption layer PIK, an absorbent layer-forming material readily penetrated by dye based color inks and readily capable of dye fixation, such as polyvinyl alcohol or the like, is used to form a layer having thickness of up to about 50 μm on the substrate surface of the translucent substrate PTK, and produces the color of the color ink in question through fixation of the dye contained in a penetrating color ink of any of the aforementioned colors. In this case, if there is color mixing of color inks, a color resulting from color mixing is produced.

Figure 6B:
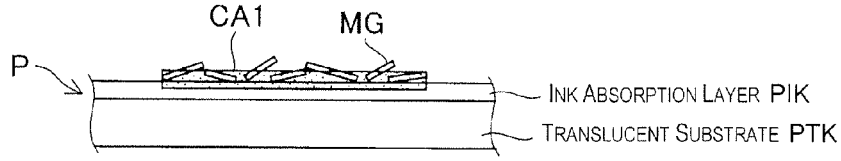

In Step S118 of FIG. 5, through ejection of metallic ink from the ink ejection head 248 of the print head 241 by the metallic dot forming module 47 of the printing control module 46, a metallic area MA of the ink in question is printed onto the ink absorption layer PIK side of the printing medium P. In this case, as discussed above, printing of the dye based color producing area CA1 of dye based color ink is carried out simultaneously during a single pass of the print head 241 along the main scanning direction (FIG. 6B). Specifically, the metallic ink and the dye based color ink are printed through ejection by leader nozzle groups.

Because, as noted previously, the metallic ink is an oil base ink composition containing a metal pigment, the ink does not penetrate into the ink absorption layer PIK but instead accumulates on the absorbent layer surface to form the printed metallic area MA. However, just after the moment of arrival at the printing medium P, the metal pigment MG contained therein has not oriented into a regular arrangement. Consequently, tiny gaps are present between adjacent metal pigment MG particles or overlapping metal pigment MG particles, and therefore the dye based color ink which has been ejected during the same main scan penetrates into the ink absorption layer PIK through these tiny gaps (FIG. 6B).

Figure 6C:
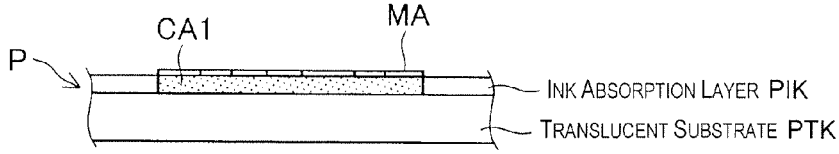

Consequently, as shown in FIG. 6C, the dye based color ink penetrates into the ink absorption layer PIK situated to the lower side of the metallic area MA where the dye becomes fixed, producing in the ink absorption layer PIK to the lower side of the metallic area MA a dye based color producing area CA1 with high color saturation and similar in shape to the metallic area MA. By the time that the printing medium P travels in the sub-scanning direction and the next main scan is carried out by the print head 241, the metal pigment MG orients into a regular arrangement in the metallic area MA and gives rise to a metallic effect. In FIG. 6C, the dye based color producing area CA1 is depicted as producing color by uniform penetration to the lowermost face in the thickness direction of the ink absorption layer PIK; however, where smaller amounts of ink are used, it is not necessary for the ink to penetrate to the lowermost face, and a color production by a concentration gradient of progressively higher density towards the surface is also acceptable.

After the printing medium P travels in the sub-scanning direction, specifically, during the next main scan of the print head 241, pigment based color ink is ejected onto the metallic area MA by the follower nozzle group to form a pigment based color producing area CA2. Because the pigment based color ink does not penetrate into the metallic area MA, it collects on the upper face of the metallic area MA.

In the non-metallic area on the other hand, printing with metallic ink in Step S112 of FIG. 5 is not carried out. Therefore, through printing with dye based color ink alone in Step S114, only a color producing area CA1 is printed with the dye based color ink that has penetrated into the ink absorption layer PIK.

Through the printing process described above, the printing system 10 carries out printing of the metallic area MA using metallic ink and printing of the dye based color producing area CA1 using dye based color inks of the colors cyan (C), magenta (M), yellow (Y), and black (K) onto the translucent printing medium P having the ink absorption layer PIK on the printing face side, doing so in the course of the same main scan. Because printing of the metallic area MA and printing of the dye based color producing area CA1 are carried out in the same main scan in this way, the time required for printing can be shorter. Moreover, while the printing system 10 carries out printing of the metallic area MA and printing of the dye based color producing area CA1 in the same main scan, as shown in FIG. 6C, through penetration of the dye based color ink into the ink absorption layer PIK, the dye based color producing area CA1 is formed with high color saturation to the lower layer side of the metallic area MA of metallic ink. Further, in the printing system 10, printing of the pigment based color producing area CA2 to the upper layer side of the metallic area MA is carried out in the main scan subsequent to travel of the printing medium P in the sub-scanning direction.

Figure 6D:
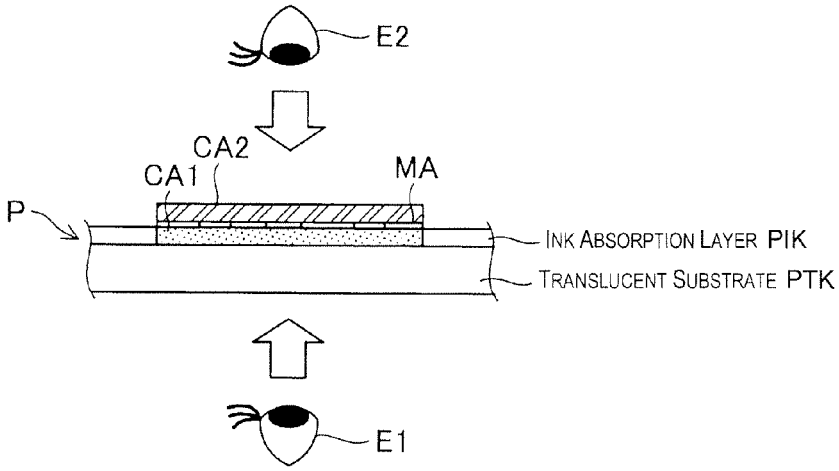

If the printed result obtained with the translucent printing medium P in the printing system 10 of the present embodiment is viewed from the back face side of the ink-imprinted face, i.e., looking through the medium from the lower side in FIG. 6D (E1), the dye based color producing area CA1 of dye based color ink that has penetrated into the ink absorption layer PIK is seen to overlap the metallic area MA which is printed with metallic ink. The dye based color producing area CA1 which overlaps the metallic area MA printed with metallic ink produces the color of the dye based color ink with good color saturation. Moreover, because the color ink of the dye based color producing area CA1 is dye based and therefore highly translucent, the metallic effect of the metallic area MA located at the lower layer side does not suffer. As a result, according to the printing system 10 of the present embodiment, it is possible both to preserve the metallic effect and to preserve the color saturation of color printing in an image that is printed using metallic ink and dye based color ink concomitantly.

Additionally, if the printed result obtained with the translucent printing medium P in the printing system 10 of the present embodiment is viewed from the ink-imprinted face side, i.e., looking through the medium from the upper side in FIG. 6D (E2), because the pigment based color producing area CA2 is formed to the near side of the metallic area MA, an image composed of dots formed from the pigment based color ink is discernible. Specifically, at the site of three-layer printing on the printing medium P, there can be discerned images composed of dots formed from different types of ink on the ink-imprinted face versus the back face. Consequently, for example, the metallic area MA may be made coextensive with the entire printing medium P; and by providing two sets of image data, namely, image data for forming the dye based color producing area CA1 and image data for forming the pigment based color producing area CA2, and carrying out the printing process based on these two sets of image data, it is a simple matter to obtain a printed result having different images on the ink-imprinted face and the back face, and to do so in a single printing operation.

Moreover, with the printing system 10 of the present embodiment, it is possible both to preserve the metallic effect and to preserve color saturation of color printing in an image that is printed using metallic ink, dye based color ink, and pigment based color ink concomitantly using the inkjet system printing method which enjoys widespread use as a printing method.

A4. Second Printing Mode

In the flowchart shown in FIG. 5, when the user selects the second printing mode, the computer 100 executes the second printing mode.

Figure 7:
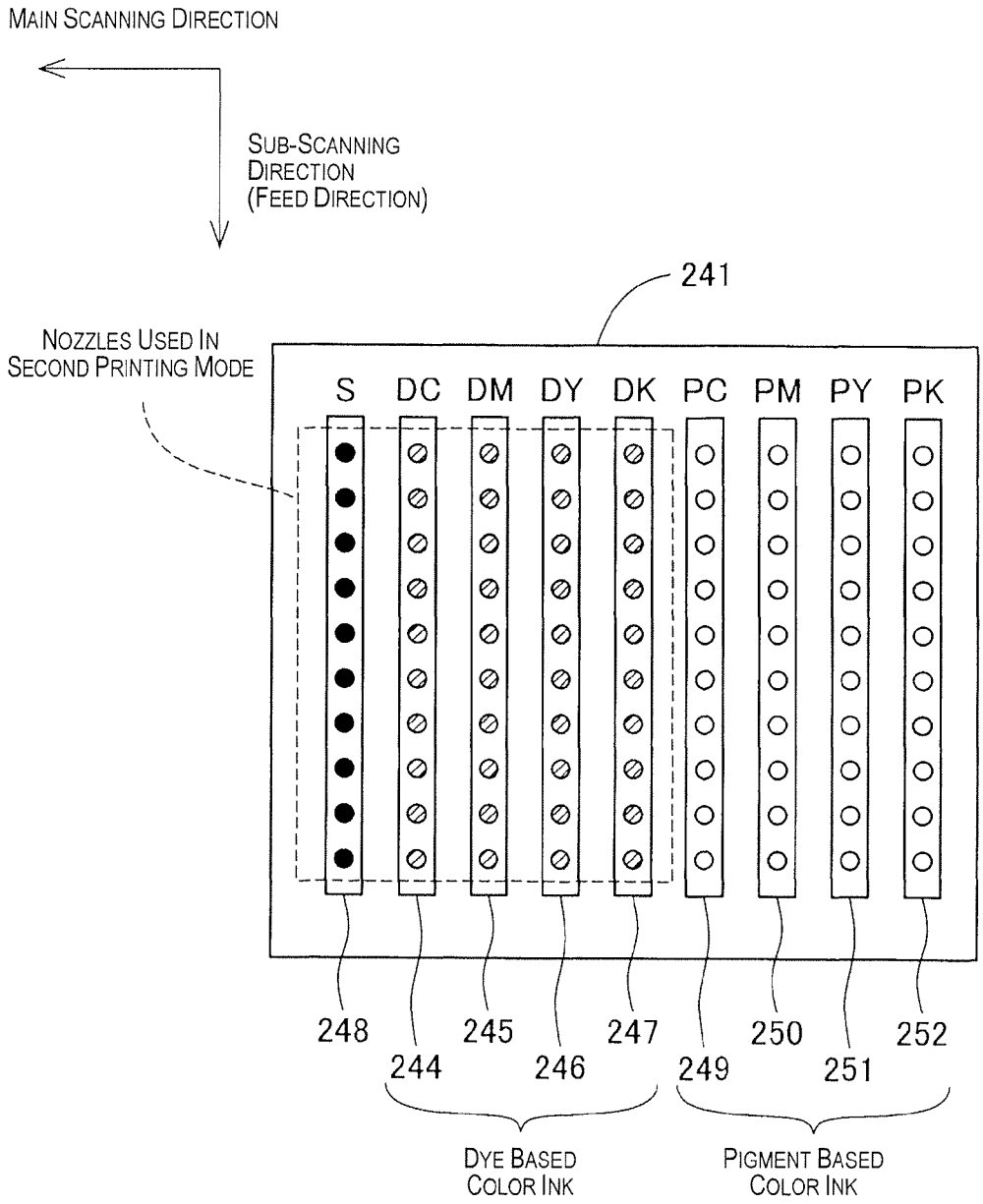
FIG. 7 is an illustration depicting nozzle usage according to a second printing mode.

FIG. 7 is an illustration depicting nozzle usage in a second printing mode. In this second printing mode, the metallic area MA and the dye based color producing area CA 1 are formed using all of the nozzles 248 that eject the metallic ink and all of the nozzles 244 to 247 that eject the dye based color inks. The nozzles 249 to 252 that eject the pigment based color ink are not used.

Figure 8A:
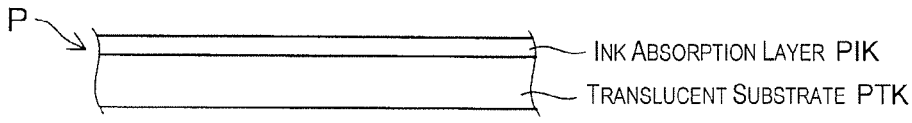
FIGS. 8A to 8C are illustrations depicting conditions of printing according to the second printing mode.
Figure 8B:
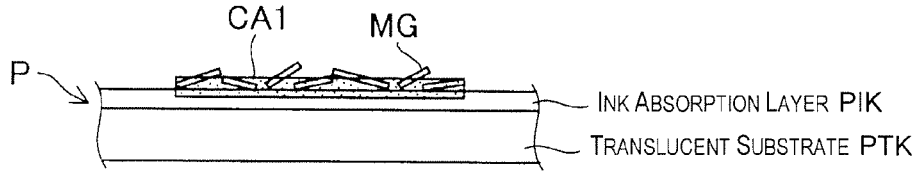
Figure 8C:
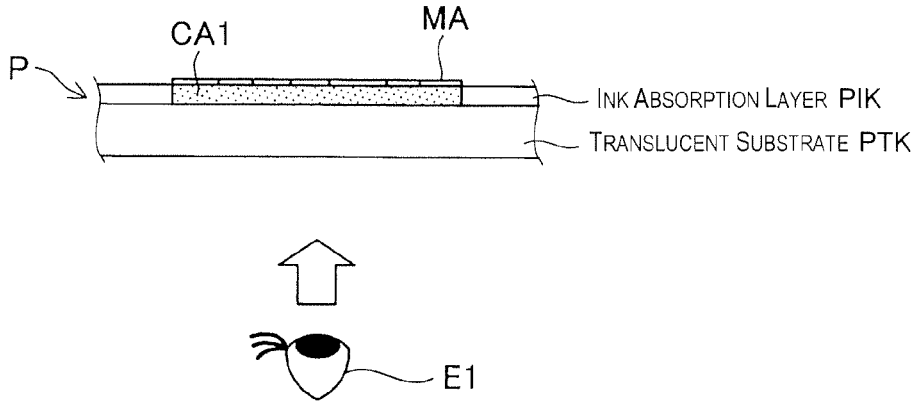

FIGS. 8A to 8C are illustrations depicting conditions of printing according to the second printing mode. The differences from the first printing mode shown in FIGS. 6A to 6D are that no pigment based color producing area CA2 is formed, and all of the nozzles that eject metallic ink and dye based color ink are used when printing the metallic area MA and the dye based color producing area CA1, but in all other respects the mode is the same as the first printing mode.

If the printed result obtained with the translucent printing medium P in the second printing mode is viewed from the back face side of the ink-imprinted face, i.e., looking through the medium from the lower side in FIG. 8C (E1), the dye based color producing area CA1 of dye based color ink that has penetrated into the ink absorption layer PIK is seen to overlap the metallic area MA which is printed with metallic ink. The dye based color producing area CA1 which overlaps the metallic area MA printed with metallic ink produces the color of the dye based color ink with good color saturation. Moreover, because the color ink of the dye based color producing area CA1 is dye based and therefore highly translucent, the metallic effect of the metallic area MA located at the lower layer side is not compromised. Further, because all of the nozzles that eject metallic ink and dye based color ink are used when printing the metallic area MA and the dye based color producing area CA1, the time required for printing is shorter than in the first printing mode.

A5. Third Printing Mode

In the flowchart shown in FIG. 5, when the user selects the third printing mode, the computer 100 executes the second printing mode.

Figure 9:
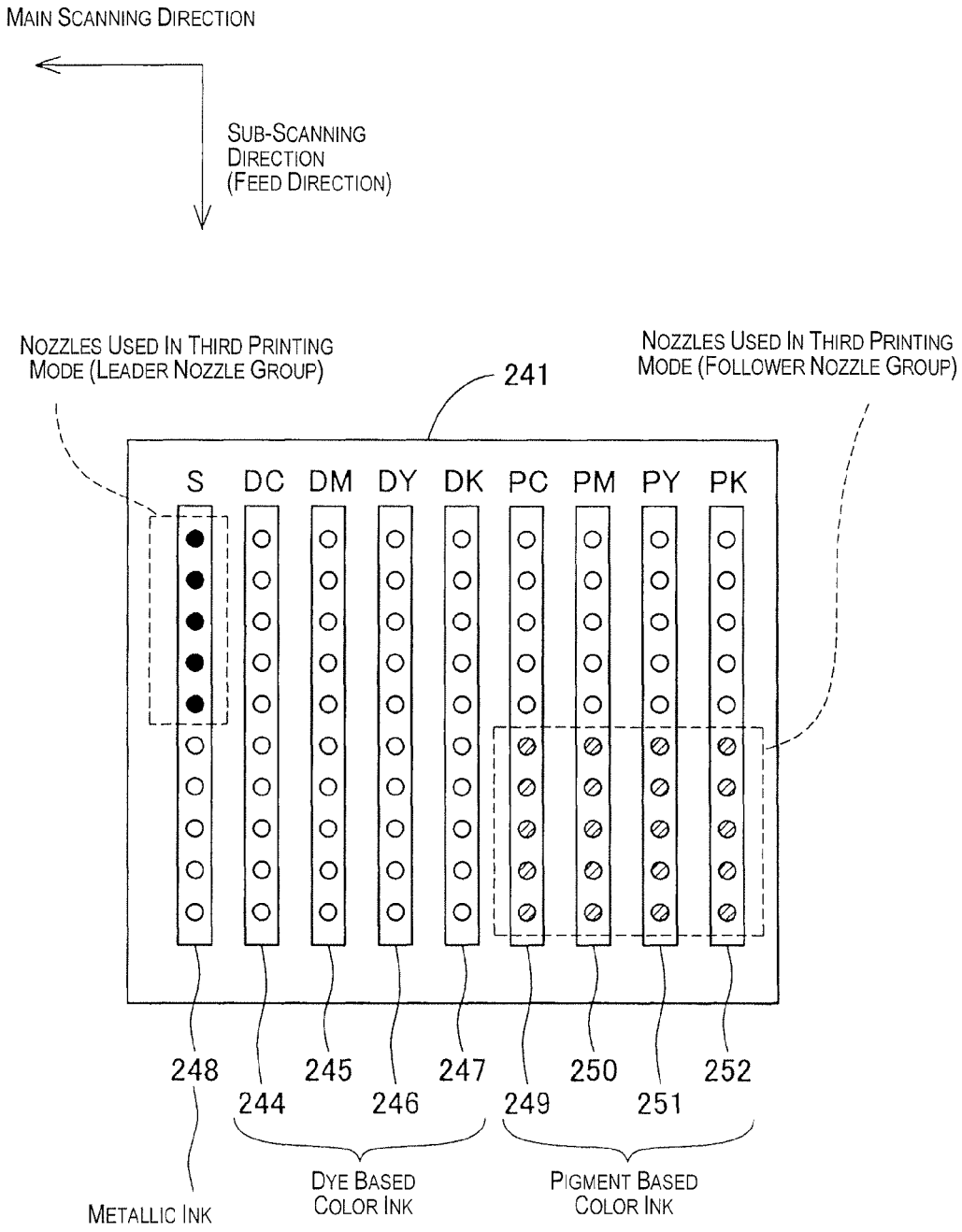
FIG. 9 is an illustration depicting nozzle usage according to a third printing mode.

FIG. 9 is an illustration depicting nozzle usage according to the third printing mode. In this third printing mode, the metallic area MA and the pigment based color producing area CA2 are formed using the leader nozzle group of the nozzles 248 that eject the metallic ink and the follower nozzle group of the nozzles 244 to 247 that eject the pigment based color ink.

Figure 10A:
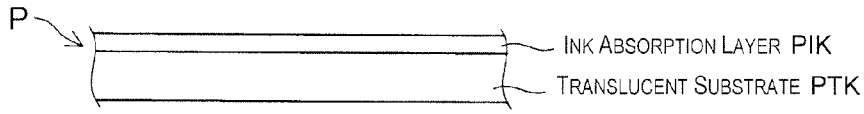
FIGS. 10A to 10D are illustrations depicting conditions of printing according to the third printing mode.
Figure 10B:
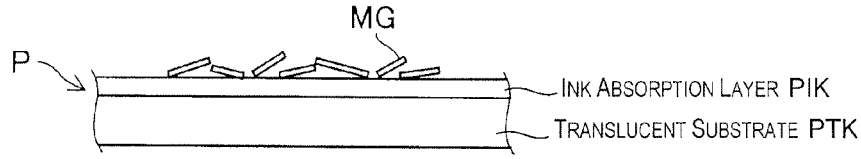
Figure 10C:
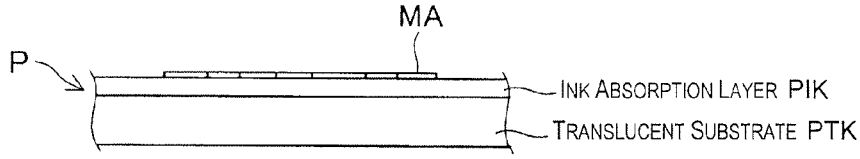
Figure 10D:
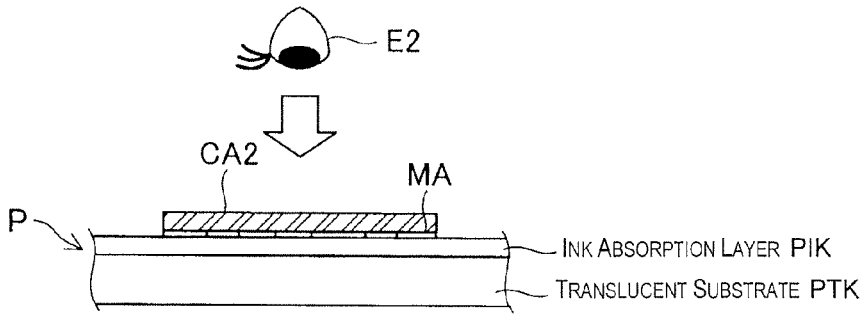

FIGS. 10A to 10D are illustrations depicting conditions of printing according to the third printing mode. The difference from the first printing mode shown in FIGS. 6A to 6D is that, of the leader nozzle group, the nozzles that eject the dye based color inks are not used and no dye based color producing area CA1 is formed, but in all other respects the mode is the same as the first printing mode. Specifically, in the third printing mode, the metallic area MA is printed using the leader nozzle group that ejects the metallic ink (FIGS. 10B and 10C), and in the main scan after the printing medium P has traveled in the sub-scanning direction, the pigment based color producing area CA2 is printed using the follower nozzle group that ejects the pigment based color ink (FIG. 10D).

If the printed result obtained with the translucent printing medium P in the third mode is viewed from the ink-imprinted face side, i.e., looking through the medium from the upper side in FIG. 10D (E2), because the pigment based color producing area CA2 is formed to the near side of the metallic area MA, the image formed by the pigment based color ink is discernible.

B. Other Embodiments

The third printing mode described above may also be executed by print heads having the configurations described next.

Figure 11:
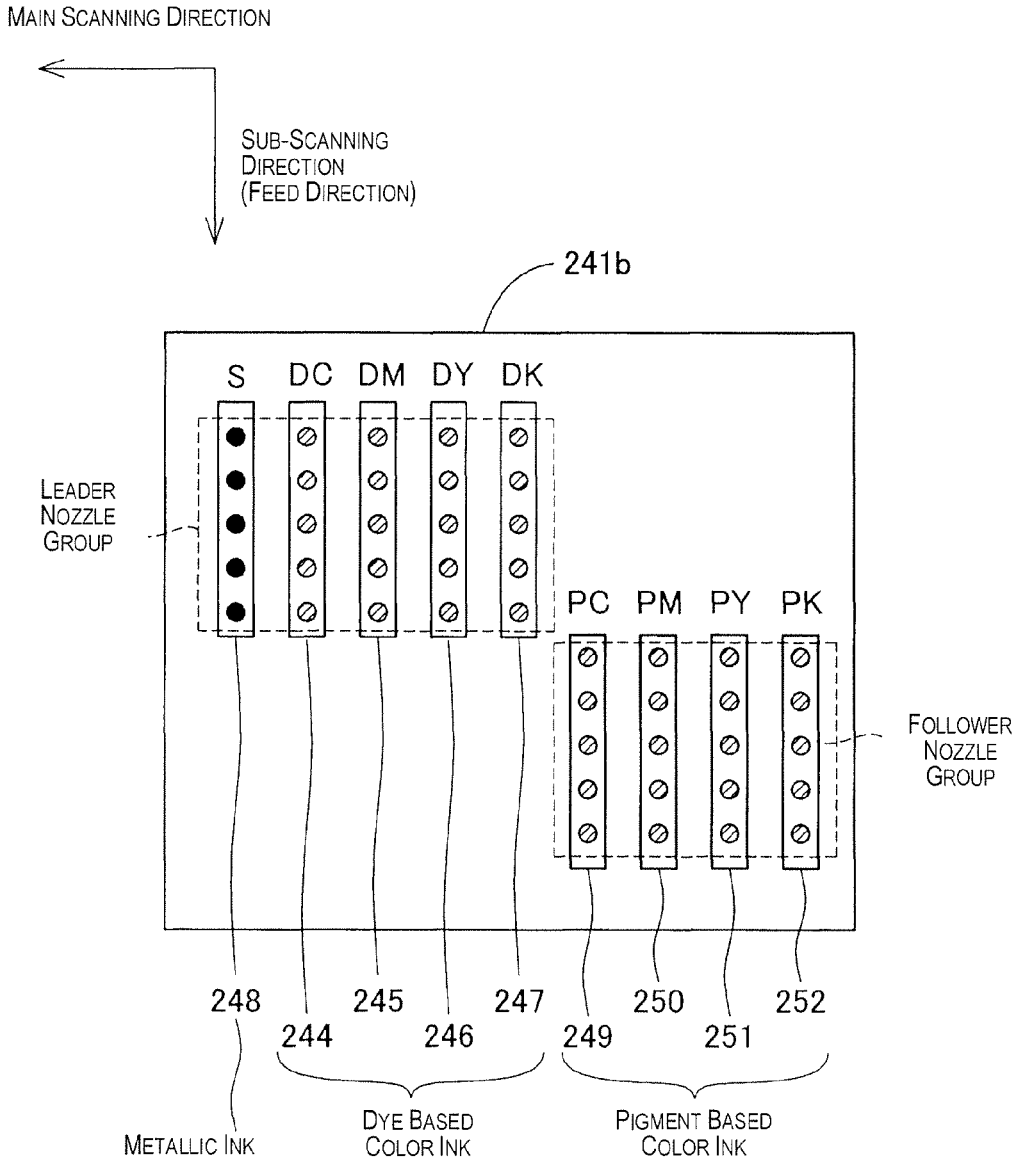
FIG. 11 is an illustration of a simplified depiction of nozzle positioning in ink ejection heads that constitute a print head 241*b* according to another embodiment.

FIG. 11 is an illustration of a simplified depiction of nozzle positioning in ink ejection heads that make up a print head 241*b* according to another embodiment. As shown in FIG. 11, the print head 241*b* has a leader nozzle group provided with an ink ejection head 248 for ejecting metallic ink and ink ejection heads 244 to 247 for ejecting dye based color inks, and a follower nozzle group provided with ink ejection heads 249 to 252 for ejecting pigment based color inks. Specifically, in the print head 241*b*, the follower nozzle group is not furnished with the ink ejection head 248 for ejecting the metallic ink and ink ejection heads 244 to 247 for ejecting the dye based color inks, and the leader nozzle group is not furnished with the ink ejection heads 249 to 252 for ejecting the pigment based color inks. The three printing modes described in the preceding embodiment may be executed with this configuration as well. However, when executing the second printing mode, printing is carried out using the leader nozzle group only.

Figure 12:
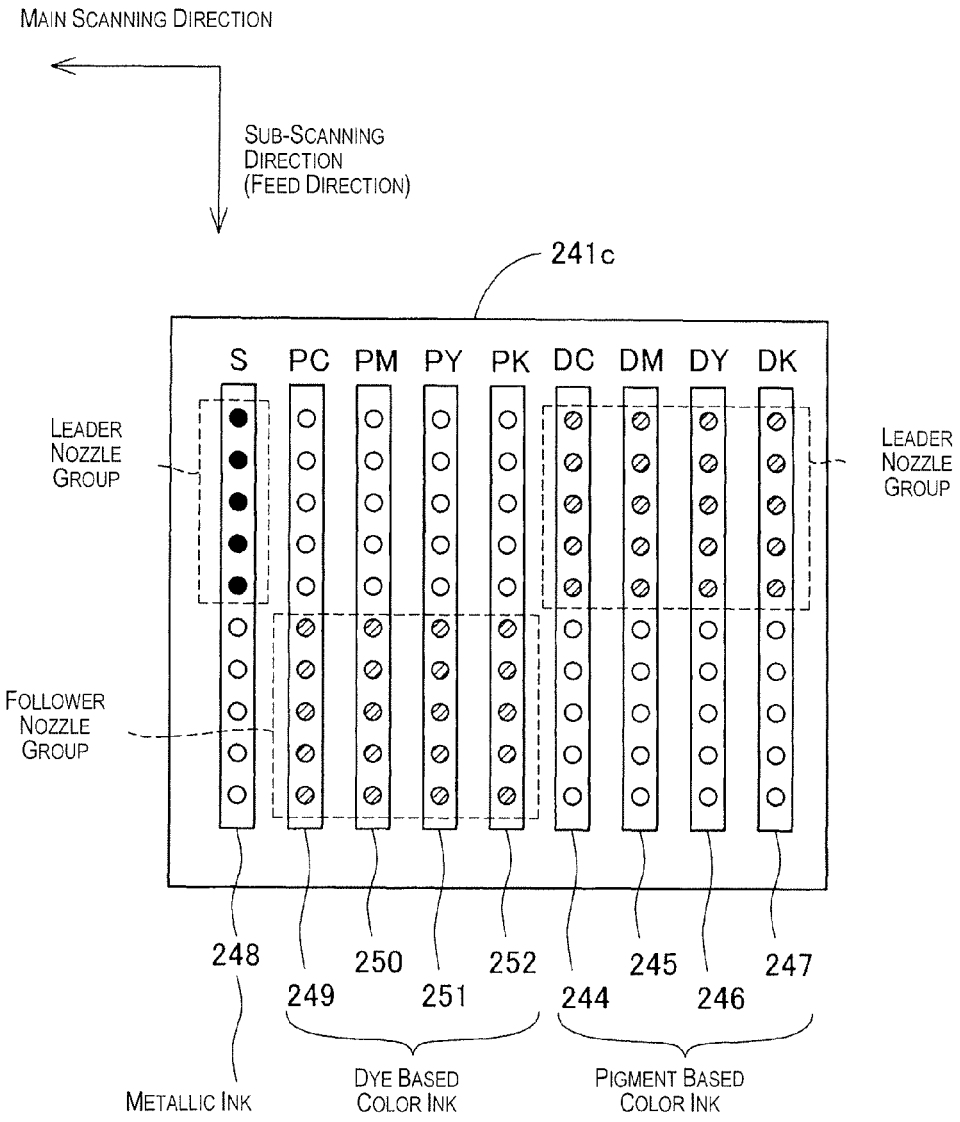
FIG. 12 is an illustration of a simplified depiction of nozzle positioning in ink ejection heads that constitute a print head 241*c* according to another embodiment.

FIG. 12 is an illustration of a simplified depiction of nozzle positioning in ink ejection heads that make up a print head 241*c* according to another embodiment. The difference from the print head 241 shown in FIG. 4 is that the positioning of the ink ejection heads 244 to 247 that eject the dye based color inks and the ink ejection heads 249 to 252 that eject the pigment based color inks is reversed. Specifically, in the print head 241*c*, the ink ejection head 248 that ejects the metallic ink, ink ejection heads 249 to 252 that eject the pigment based color inks, and the ink ejection heads 244 to 247 that eject the dye based color inks are positioned in that order. The three printing modes described in the preceding embodiment may be executed with this configuration as well.

Figure 13:
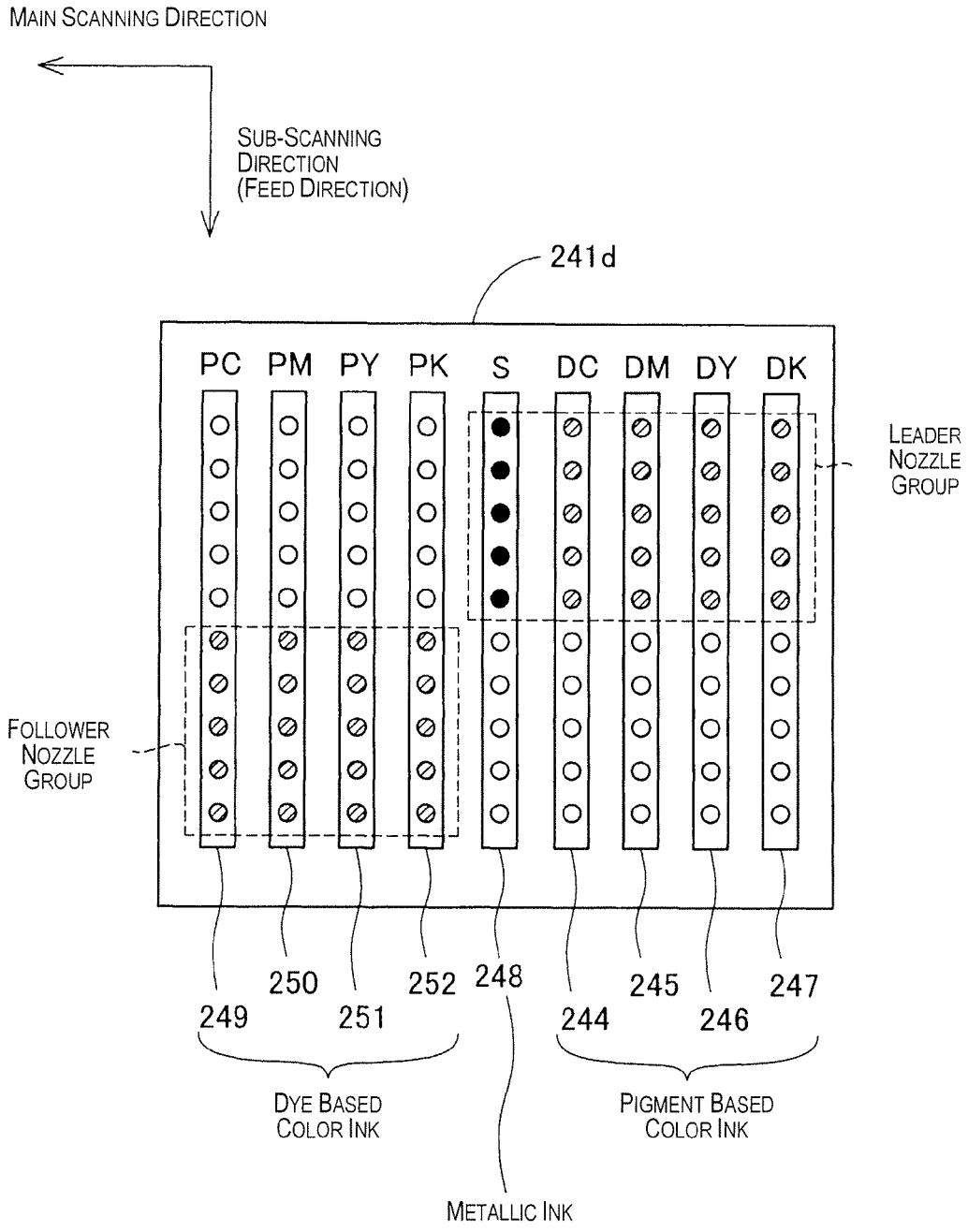
FIG. 13 is an illustration of a simplified depiction of nozzle positioning in ink ejection heads that constitute a print head 241*d* according to another embodiment.

FIG. 13 is an illustration of a simplified depiction of nozzle positioning in ink ejection heads that make up a print head 241*d* according to another embodiment. The difference from the print head 241*c* shown in FIG. 12 is that the ink ejection head 248 that ejects the metallic ink is positioned between the ink ejection heads 244 to 247 that eject the dye based color inks and the ink ejection heads 249 to 252 that eject the pigment based color inks. The three printing modes described in the preceding embodiment may be executed with this configuration as well.

C. MODIFIED EXAMPLES

It is to be understood that the embodiments described hereinabove are not limiting of the invention, and that various other modes are possible without departing from the scope of the invention, such as the following modifications for example.

Modified Example 1

In the preceding embodiments, printing with metallic ink is carried out by the printing system 10 which includes the computer 100 and the printer 200. However, optionally, the printer 200 itself may input image data from a digital camera or memory card of any of various formats, and print the image with metallic ink. That is, the CPU in the control circuit 260 of the printer 200 may carry out printing with metallic ink through execution of a process comparable to the printing process in the embodiments described above.

Modified Example 2

Whereas the preceding embodiments describe examples in which the specialty gloss ink is metallic ink, pearlescent gloss inks containing pigments that have a pearlescent gloss effect once fixed onto the surface of a medium, for example, a pigment containing multiple stacked thin layers having a pearl color like natural pearl, or lamé inks or translucent inks containing pigments that have microscopic irregularities so as to give rise to scattered reflection once fixed onto the surface of a medium to create a so-called lamé or translucent effect, may be used in place of metallic ink. Optionally, an opaque white ink may be used in place of metallic ink. The white ink may be one containing hollow resin particles as coloring material, for example.

Modified Example 3

In the first printing mode described in the preceding embodiment, the pigment based color producing area CA2 is formed over the metallic area MA; however, dye based color ink may be printed over the metallic area MA to form a color producing area instead. During this process, optionally, a clear layer for inhibiting penetration of the dye-based ink into the metallic area MA may be formed over the metallic area MA. Optionally, a three-layer metallic/color area may be formed by printing of pigment based color ink, metallic ink, and pigment based color ink in that order. That is, color materials having identical qualities may used to either side of the metallic area MA.

Modified Example 4

While the preceding embodiment describes a serial printer in which the print head 241 travels in the main scanning direction, the present invention may also be implemented in a line printer having a line head in which the nozzles that eject the ink are arrayed in the width direction of the printing medium. Specifically, the nozzles that eject the pigment based color inks may be positioned to the downstream side of the nozzles that eject the dye based color inks and the nozzles that eject the metallic ink, in the direction of conveyance of the printing medium with respect to the line head.

Modified Example 5

While the preceding embodiment describes printing modes for carrying out printing of a translucent printing medium, the printer 200 may also have printing modes for carrying out printing of non-translucent printing media (e.g., plain paper or the like).

Modified Example 6

In Step S114 of the preceding embodiment, in instances of printing without using metallic ink, dots are formed using dye based color inks; however, dots could be formed using pigment based color inks instead.

Modified Example 7

According to the preceding embodiment, the computer 100, using the printing control module 46 to control the printer 200, commences printing after the halftoning process is finished for the entirety of the image being printed (FIG. 5: Step S108); however, the computer 100, using the printing control module 46 to control the printer 200, could instead commence printing after the halftoning process is finished for a portion of the image being printed.

Modified Example 8

In the preceding embodiment, a print head capable of producing dots of several different sizes, such as large, medium, and small, may be used.

Modified Example 9

Some of the functions accomplished through software in the preceding embodiments may instead be accomplished through hardware, or some of the functions accomplished through hardware may instead be accomplished through software.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device for carrying out printing on a translucent printing medium, the printing device comprising:

a conveying portion configured to convey the printing medium in a conveyance direction;

a print head for an ink jet printer of a serial printer having a first applying portion, a second applying portion, and a third applying portion, the first applying portion including a first ink ejection head that has a first nozzle and a second nozzle, the first nozzle and the second nozzle being configured to apply a first color material onto the printing medium and arranged in the conveyance direction, the second applying portion including a second ink ejection head that has a third nozzle and a fourth nozzle, the third nozzle and the fourth nozzle being configured to apply a second color material onto the printing medium and arranged in the conveyance direction, the third applying portion including a third ink ejection head that has a fifth nozzle and a sixth nozzle, the fifth nozzle and the sixth nozzle being configured to apply an opaque specialty ink onto the printing medium and arranged in the conveyance direction, the first, third, and fifth nozzles being disposed upstream with respect to the second, fourth, and sixth nozzles in the conveyance direction; and a printing control portion configured to execute printing on the printing medium being conveyed such that a first color-producing layer of the first color material is formed by the first nozzle and the second nozzle, a second color-producing layer of the second color material is formed by the third nozzle and the fourth nozzle, and an opaque light-blocking layer of the specialty ink is formed by the fifth nozzle and the sixth nozzle, the printing control portion executing printing on the printing medium in a first printing mode in such that the first color-producing layer of the first color material is formed using the first nozzle of the first applying portion, the opaque light-blocking layer of the specialty ink is formed over the first color producing layer using the fifth nozzle of the third applying portion, and the second color-producing layer of the second color material is formed over the light-blocking layer using the fourth nozzle of the second applying portion after the light-blocking layer is formed and while the third nozzle of the second applying portion does not apply the second color material onto the printing medium.

2. The printing device according to Claim 1, wherein the first color material is a dye-based ink, the second color material is a pigment-based ink, and the specialty ink is a specialty gloss ink.

3. The printing device according to claim 1, wherein the printing control portion is further configured to execute printing on the printing medium being conveyed according to a second printing mode which is a printing mode different from the first printing mode, so that the first color-producing layer of the first color material is formed on the printing medium using the first applying portion, and the opaque light-blocking layer of the specialty ink is formed on the printing medium using the third applying portion in the second printing mode.

4. The printing device according to claim 3, wherein the printing control portion is further configured to execute printing on the printing medium being conveyed according to a third printing mode which is a printing mode different from the first and second printing modes, so that the opaque light-blocking layer of the specialty ink is formed on the printing medium using the third applying portion, the second color-producing layer of the second color material is formed over the light-blocking layer using the second applying portion after the light-blocking layer is formed.

5. The printing device according to claim 4, further comprising a selection portion providing an interface allowing selection of one of the first, second and third printing modes when printing is executed, the printing control portion is configured to execute printing according to the one of the first, second and third printing modes selected by the selection portion.

6. The printing device according to claim 1, wherein the print head is a serial head that travels relative to a width direction of the printing medium, the first, second and third applying portions include nozzles configured to respectively eject the first and second color materials and the specialty ink, the nozzles being arrayed in a direction that intersects a direction of travel of the serial head, and the conveying portion is configured to convey the printing medium relative to the direction that intersects the direction of travel of the serial head.

7. The printing device according claim 6, wherein the printing control portion is configured to carry out formation of the light-blocking layer concurrently with formation of the first color-producing layer in a single pass of travel by the serial head, and the printing control portion is configured to carry out formation of the second color-producing layer during travel which chronologically follows traveling of the serial head during which the light-blocking layer was formed.

8. The printing device according to claim 1, wherein the first, second and third applying portions include nozzles configured to respectively eject the first and second color materials and the specialty ink, the print head is a line head in which the nozzles are arrayed in a width direction of the printing medium, and the nozzles belonging to the second applying portion are disposed on a downstream side of the first and third applying portions, in a direction in which the printing medium is conveyed by the conveying portion with respect to the line head.

9. A printing method for printing onto a translucent printing medium, the printing method comprising:

conveying the printing medium in a conveyance direction;

forming a first color-producing layer on the printing medium using a first color material by a first nozzle that a first ink ejection head includes, the first ink ejection head further including a second nozzle, the first nozzle and the second nozzle being configured to apply the first color material onto the printing medium and arranged in the conveyance direction, and forming an opaque light-blocking layer over the first color-producing layer using a specialty ink by a third nozzle that a second ink ejection head includes, the second ink ejection head further including a fourth nozzle, the third nozzle and the fourth nozzle being configured to apply the specialty ink onto the printing medium and arranged in the conveyance direction; and forming a second color-producing layer over the light-blocking layer using a second color material by a fifth nozzle that a third ink ejection head includes, the third ink ejection head further including a sixth nozzle, the fifth nozzle and the sixth nozzle being configured to apply the second color material onto the printing medium and arranged in the conveyance direction, the second color-producing layer being formed by the fifth nozzle, while the sixth nozzle does not apply the second color material, the first, third, and sixth nozzles being disposed upstream with respect to the second, fourth, and fifth nozzles in the conveyance direction.

10. A printing device for carrying out printing of a printing medium, the printing device comprising:

a conveying portion configured to convey the printing medium in a conveyance direction;

a print head for an ink jet printer of a serial printer having a first applying portion, a second applying portion, and a third applying portion, the first applying portion including a first ink ejection head that has a first nozzle and a second nozzle, the first nozzle and the second nozzle being configured to apply a dye-based ink and arranged in the conveyance direction, the second applying portion including a second ink ejection head that has a third nozzle and a fourth nozzle, the third nozzle and the fourth nozzle being configured to apply a pigment-based ink and arranged in the conveyance direction, the third applying portion including a third ink ejection head that has a fifth nozzle and a sixth nozzle, the fifth nozzle and the sixth nozzle being configured to apply a specialty gloss ink and arranged in the conveyance direction, the first, third, and fifth nozzles being disposed upstream with respect to the second, fourth, and sixth nozzles in the conveyance direction; and a printing control portion configured to execute printing on the printing medium being conveyed such that a first color-producing layer of the dye-based ink is formed by the first nozzle and the second nozzle, a second color-producing layer of the pigment-based ink is formed by the third nozzle and the fourth nozzle, and an opaque light-blocking layer of the specialty gloss ink is formed by the fifth nozzle and the sixth nozzle, the printing control portion executing printing on the printing medium in a printing mode such that the first color-producing layer of the dye-based ink is formed using the first nozzle of the first applying portion, an opaque light-blocking layer of the specialty gloss ink is formed over the first color-producing layer using the fifth nozzle of the third applying portion, and the second color- producing layer of the pigment-based ink is formed over the light-blocking layer using the fourth nozzle of the second applying portion after the light-blocking layer is formed while the third nozzle of the second applying portion does not apply the pigment-based ink onto the printing, such that the opaque light-blocking layer is formed between the first color-producing layer and the second color-producing layer onto the printing medium.

* * * * *